United States Patent [19]

Pagani

[11] Patent Number: 5,007,636

[45] Date of Patent: Apr. 16, 1991

[54] GAME APPARATUS

[76] Inventor: David A. Pagani, 10C Seaview Mansion, Discovery Bay, Lantau, Hong Kong

[21] Appl. No.: 466,202

[22] Filed: Jan. 17, 1990

[30] Foreign Application Priority Data

Jan. 17, 1989 [GB] United Kingdom ..... 8900991

[51] Int. Cl.[5] ..... A63F 7/36

[52] U.S. Cl. ..... 273/448; 273/1; 273/450; 446/75; 446/77

[58] Field of Search ..... 273/1 R, 1 GF, 1 GG, 273/309; 446/73, 75, 76, 77

[56] References Cited

U.S. PATENT DOCUMENTS

| | | | |
|---|---|---|---|
| 3,359,677 | 12/1967 | Hepler | 446/70 |
| 3,460,831 | 8/1969 | Glass et al. | 273/1 GF |
| 3,479,762 | 11/1969 | Fischer | 446/77 |
| 3,656,746 | 4/1972 | Breslow | 273/1 GF |
| 4,149,717 | 4/1979 | Seijiro | 273/1 GF |
| 4,343,475 | 8/1982 | Stader | 273/1 GF |
| 4,662,633 | 5/1987 | Zaruba et al. | 273/1 GF |
| 4,678,188 | 7/1987 | Johnson | 273/1 R |
| 4,822,314 | 4/1989 | O'Brian et al. | 446/77 |
| 4,919,268 | 4/1990 | Young et al. | 446/73 |

FOREIGN PATENT DOCUMENTS

| | | | |
|---|---|---|---|
| 1094966 | 5/1955 | France | 446/76 |

*Primary Examiner*—Edward M. Coven
*Assistant Examiner*—William E. Stoll
*Attorney, Agent, or Firm*—Blakely, Sokoloff, Taylor & Zafman

[57] ABSTRACT

A Game Apparatus is disclosed which is capable of forming the base of many different games and which comprises a container 1 for game apparatus elements and a lid 7 for the container, an upper surface of the container being provided with attachments whereby at least some of the game apparatus elements 10 can be mounted upon the container so that the container functions as a base for the assembled game apparatus and the lid of the container 7 includes a spinner 8, 9 for randomly choosing one of a plurality of instructions for use in playing a game with the game apparatus.

12 Claims, 3 Drawing Sheets

GAME APPARATUS

This invention relates to a game apparatus.

According to a first aspect of the present invention there is provided a game apparatus which apparatus comprises a plurality of game apparatus elements, a container for the elements and a lid for the container, an upper surface of the container being provided with means whereby at least some of the game apparatus elements can be mounted upon the container so that the container functions as a base for the assembled game apparatus, and the lid of the container including means for randomly choosing one of a plurality of instructions for use in playing a game with the game apparatus.

Preferably the container is in the form of a box, e.g. a cardboard box, having an uppermost closure element with an opening for receiving the lid. Preferably the closure element is made of a plastics material and has moulded into it one or more recesses or projections for co-operating with corresponding projections or recesses on elements of the game apparatus.

Preferably the lid is divided into a plurality of sections each bearing a game instruction and is provided with a spinnable pointer for randomly selecting one of said sections.

Conveniently the game apparatus may include game elements corresponding to different levels of skill for playing the game and the game instructions may also include different sets of instructions, each corresponding to the level of skill chosen.

Embodiments of the game apparatus of the present invention will now be described, by way of example only, by reference to the accompanying drawings, in which.

Figure 2:
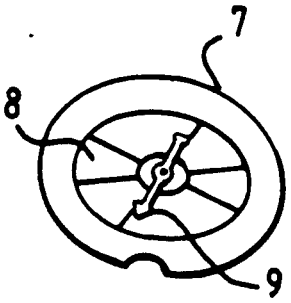
FIG. 2 is a perspective view of an embodiment of a lid according to the present invention.
Figure 1:
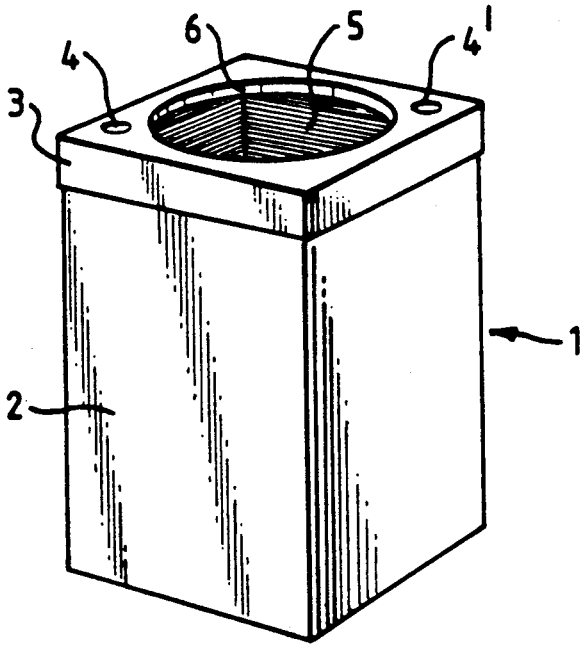
FIG. 1 is a perspective view of an embodiment of a container according to the present invention.

Referring to FIGS. 1 and 2 of the drawings, a container 1 for a games apparatus consists of a rectangular cardboard box 2 closed on five sides and provided on its uppermost, sixth side with a plastics closure element 3. The closure element is provided with a pair of diagonally opposed recesses 4,4' and defines a circular opening 5, provided with recessed peripheral flange 6. A generally circular lid 7 is adapted to be received within the opening 5 to seat upon the flange 6 to close the container 1. The upper surface of the lid 7 is divided into a plurality of sectors 8 each bearing a game instruction and a freely rotatable pointer 9 is mounted on the lid 7 for randomly selecting one of said game instructions.

Figure 3:
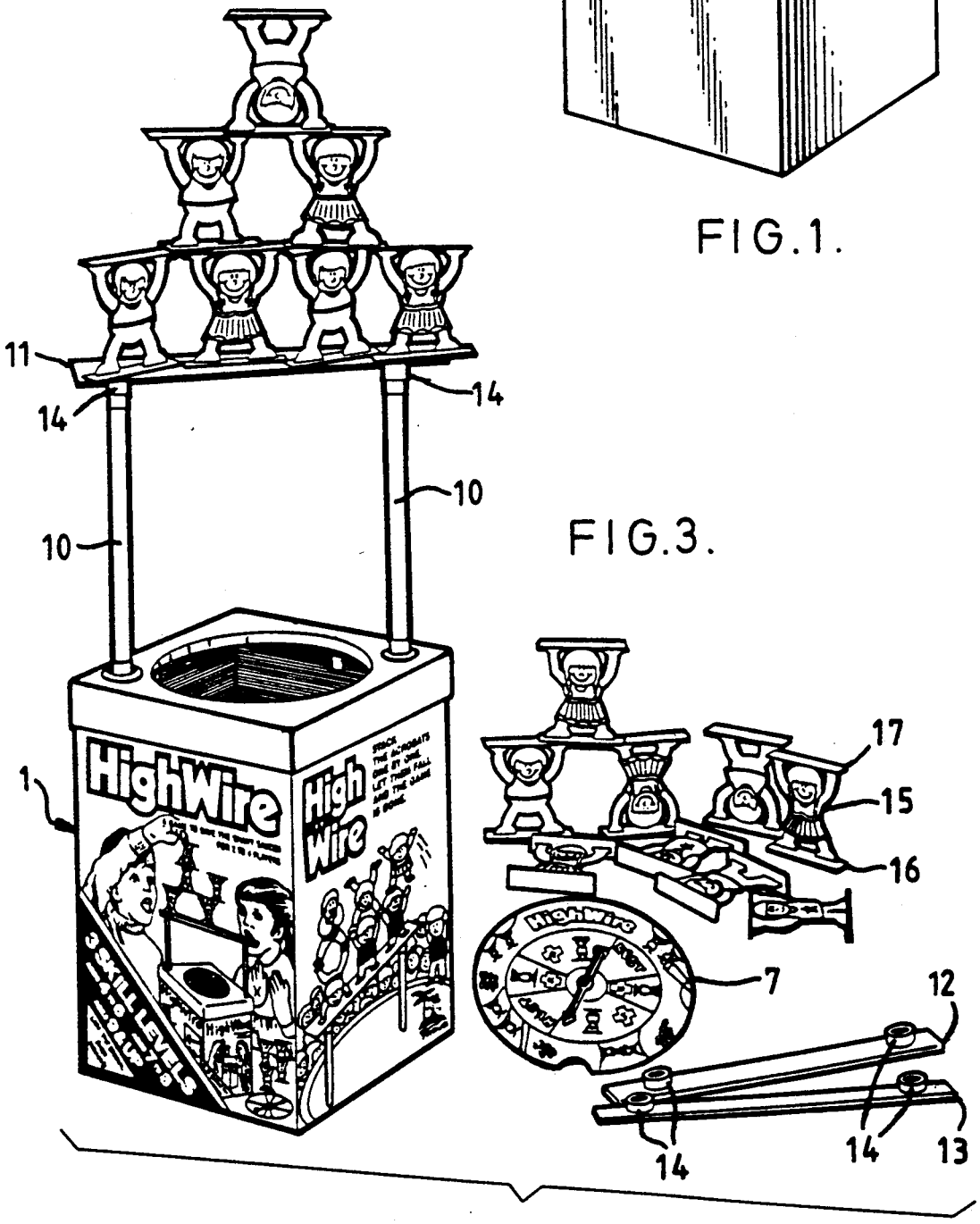
FIG. 3 is a general view of one embodiment of a game apparatus according to the present invention.

Referring now to FIG. 3 of the drawings, there is shown an embodiment of a games apparatus entitled "High Wire". The apparatus consists of a container 1 and lid 7 as hereinbefore described. The apparatus also consists of a pair of plastics rods 10 provided at their lower ends with respective projections for fitting snugly into recesses 4,4' of the closure element 3. The upper end of each rod 10 is rounded. Three beams 11, 12, 13 are provided, each beam having recess means 14 for receiving the upper ends of the rods 10 so as to be supported thereby.

Beam 11 is wider than beam 12 which in turn is wider than beam 13. The recess means 14 of beam 11 are adapted to receive the whole of the rounded ends of the rods 10 so that beam 11 sits on rods 10 relatively securely. The recess means 14 of beam 12 are adapted to receive only a portion of the rounded ends of rods 10 so that beam 12 is somewhat unstably supported by rods 10. The recess means 14 of beam 13 are relatively shallow so that beam 13 can only be balanced on rods 10 in an unstable state. A plurality of figures 15 each having a flat base 16 and a flat upper surface 17 is provided.

The sectors 8 of lid 7 respectively comprise instructions to add a figure 15 to a supported beam or to a stack of such figures already on a said beam, to remove a figure, or to miss a turn.

To play the game, a level of difficulty is chosen by supporting one of the beams 11, 12, 13 on rods 10, and the players then taking turns to spin the pointer 9 of lid 7 and following the instructions thus selected. If a figure falls off the beam during a player's turn that player is out; the eventual winner is the only player who does not cause a figure to fall or the player who placed the last possible figure.

Figure 4:
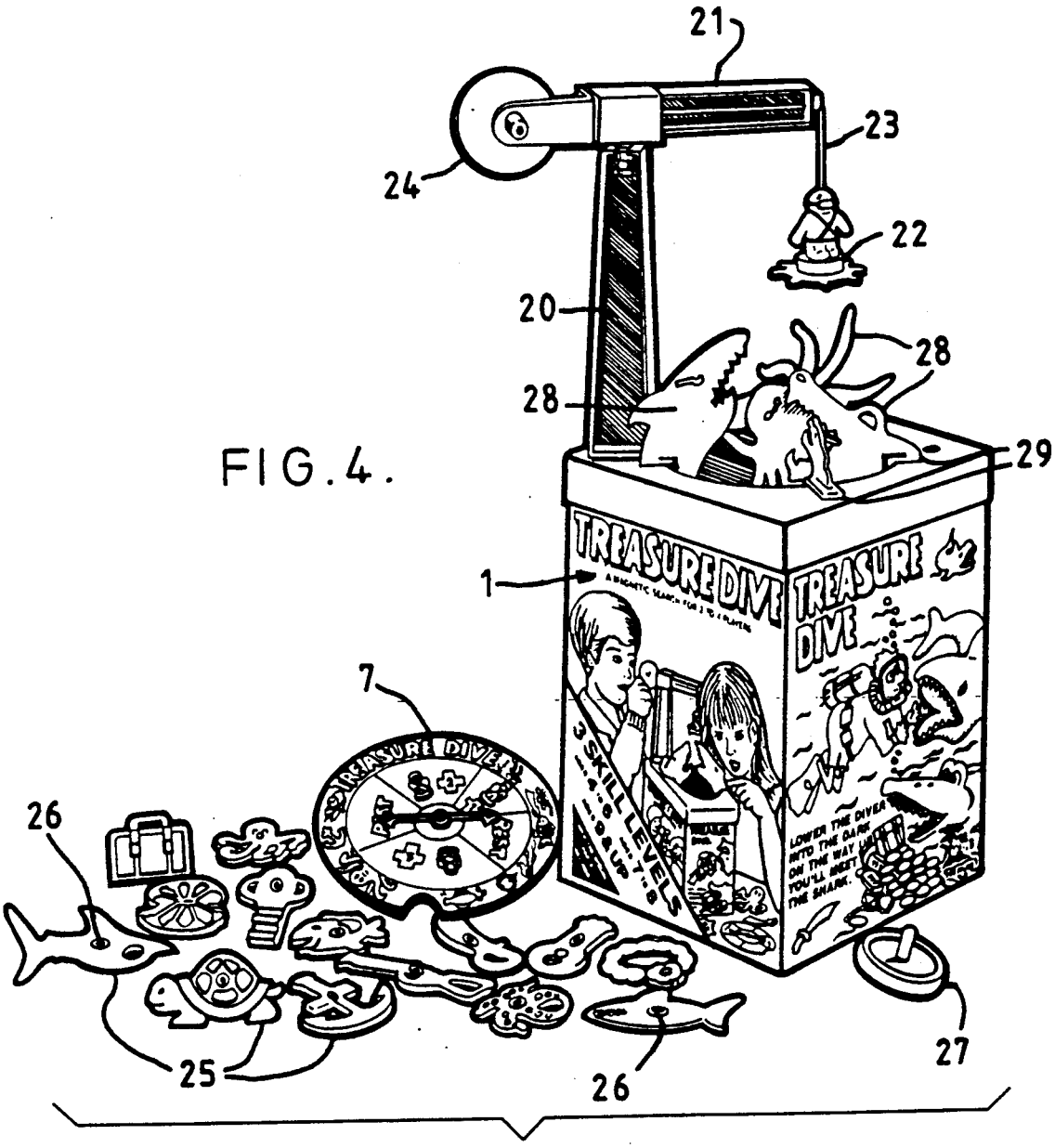
FIG. 4 is a general view of a second embodiment of a game apparatus according to the present invention.

Referring now to FIG. 4 of the drawings there is shown an embodiment of a games apparatus entitled "Treasure Dive". The apparatus consists of a container 1 and lid 7 as hereinbefore described. The apparatus also consists of a crane 20 which can be securely mounted on the closure element 3. The crane 20 includes a horizontally slidable arm 21, a magnet 22 on the end of a string 23 and a rotatable handle 24 whereby the magnet 22 may be lowered into container 1 or withdrawn therefrom. A plurality of "treasure" items 25 is provided, some coloured green and some coloured purple and each having an iron element 26 affixed thereto. A spinning top 27 is provided together with a plurality of obstacles 28 which obstacles 28 are provided with clips 29 whereby they may be clipped to the periphery of opening 5.

The respective sectors 8 of lid 7 contain instructions as to whether green, purple or any treasure items 25 are to be retrieved from container 1 by means of crane 20, together with one "miss a turn" sector.

To play the game the crane is assembled on the closure element 3 so that its arm 21 overhangs opening 5. One of more of the obstacles 28 is clipped to the periphery of the opening 5 to adjust the difficulty of the game. The pointer 9 is spun so as to randomly select an instruction. The spinning top 27 is set in motion to act as a timer. Whilst the top is in motion the player whose go it is must retrieve items 25 in accordance with the selected instruction. The winner is that player who retrieves the greater number of items 25.

Figure 5:
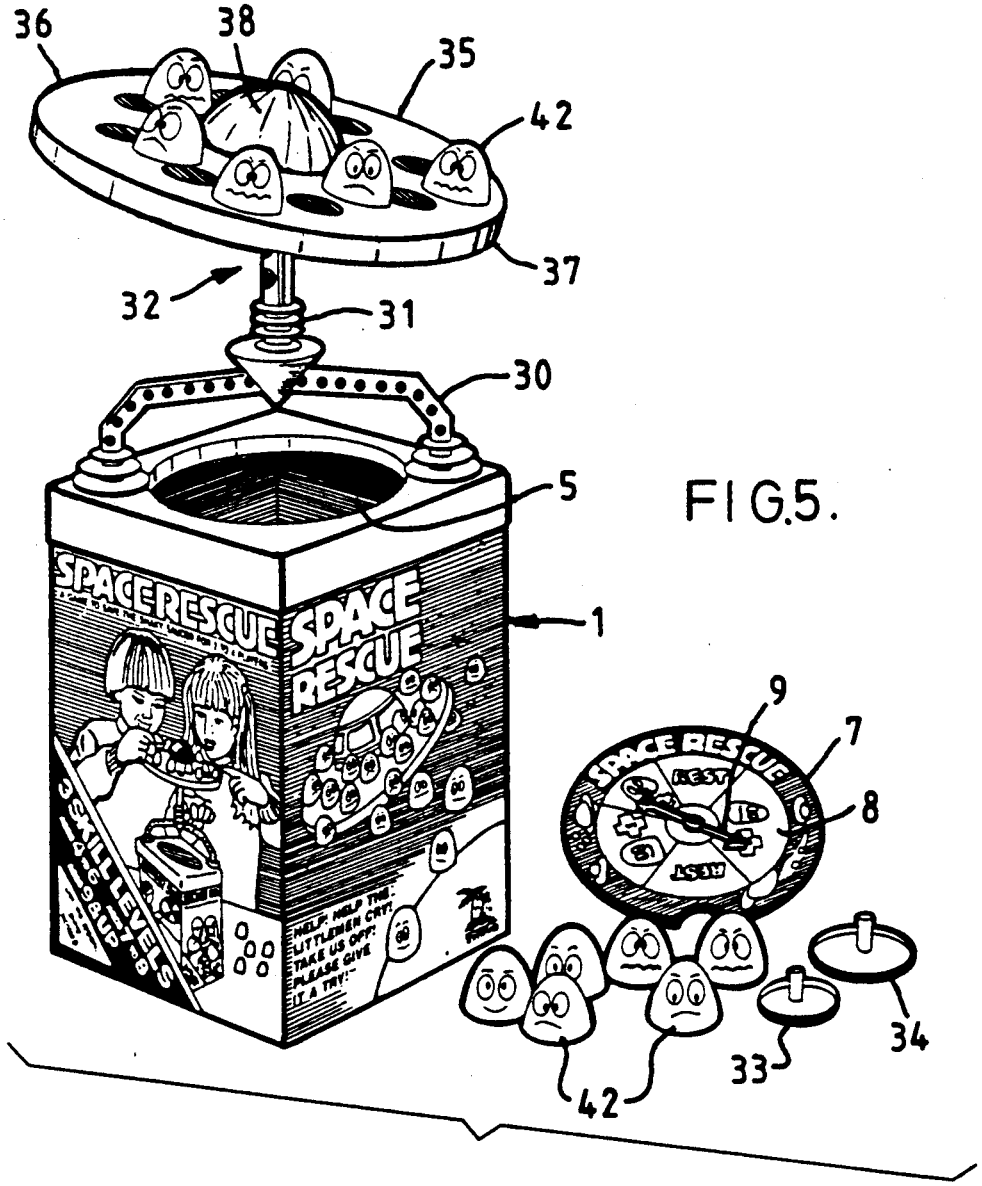
FIG. 5 is a general view of a third embodiment of a game apparatus according to the present invention.
Figure 6:
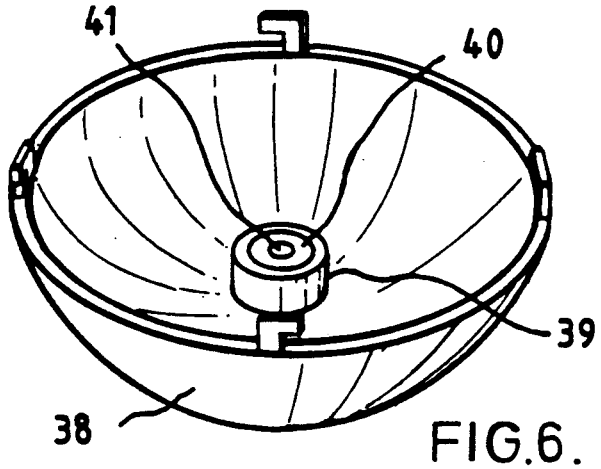
FIG. 6 is a perspective view of an element of the apparatus of FIG. 5.

Referring lastly to FIGS. 5 and 6 of the drawings, a third embodiment of a games apparatus is shown entitled "Space Rescue". The apparatus includes a container 1 and lid 7 as hereinbefore described. The apparatus also includes a bridge element 30 provided with projections to be received within recesses 4,4' so as to span the opening 5. An upstanding rod 31 is mounted upon bridge element 30 and carries at its upper end one of a plurality of supports 32, 33, 34. A circular platform 35 is assembled from two semi-circular halves 36, 37 and is secured together by means of a central domed element 38 provided with bayonet fittings for connection to the assembled platform 35. Provided centrally on the underside of domed element 38 is a locating stud 39 (FIG. 6) having a flat surface 40 provided with a central hemispherical concavity 41. Each of supports 32, 33, 34 is adapted to receive the locating stud 39 but to impart different degrees of stability to the platform 35 when it is balanced thereupon. Specifically support 32 is provided with a domed upper surface to receive the hemispherical concavity 41 of stud 39 to provide relatively stable support therefor. Support 33 is provided with a pointed, upwardly extending projection to receive the hemispherical concavity 41, to provide a support of intermediate stability. Support 34 is provided with an upwardly extending projection having a flat upper surface adapted to receive the flat surface 40 of stud 39 to provide a relatively unstable support therefor.

A plurality of weights 42 is provided respectively white, green and yellow and of different weight to each other.

The sectors 8 of the lid 7 respectively bear instructions to remove a green weight, to remove a yellow weight, to remove a white weight, to add a weight, and to miss a turn.

To play the game one of the supports 32, 33, 34 is placed on rod 31. All the weights 42 are placed on platform 35 and the assembly of platform 35 and weights 42 is then balanced on the selected support. Thereafter players take turns to spin pointer 9, and to follow the indicated instruction in selected Sector 8.

If, during or as a result of following the instruction one or more of the weights falls off the platform, then that player responsible is out. The winner is that player who does not cause a weight to fall or the player who succeeds in removing the last weight.

The invention provides a useful and amusing game apparatus, capable of forming the basis of many different games. It has the advantage that the container for the game apparatus elements forms an integral part of the assembled apparatus and can be used in a game itself.

The invention may be performed otherwise than as has been particularly described; the invention includes within its scope all modifications or improvements which would be apparent to one skilled in the art.

I claim:

1. A Game Apparatus comprising a plurality of game apparatus elements, a container for the elements and a lid for the container, an upper surface of the container being provided with means for mounting at least some of the game apparatus elements upon the container so that the container functions as a base for the assembled game apparatus and the lid of the container including means for randomly choosing one of a plurality of instructions for use in playing a game with the game apparatus.

2. Apparatus as claimed in claim 1 wherein the container is in the form of a box having an uppermost closure element with an opening for receiving the lid.

3. Apparatus as claimed in claim 2 wherein the closure element is formed of a plastics material.

4. Apparatus as claimed in claim 2 or claim 3 wherein the closure element is provided with one or more recesses or projections for co-operation with corresponding projections or recesses on elements of the game apparatus.

5. Apparatus as claimed in any one of claims 1 to 3 wherein the lid is divided into a plurality of sections each bearing a game instruction.

6. Apparatus as claimed in claim 5 wherein the lid is provided with a spinable pointer for randomly selecting one of said sections.

7. Apparatus as claimed in any one of claims 1 to 3 wherein the game apparatus includes game elements corresponding to different levels of skill for playing the game.

8. Apparatus as claimed in claim 7 wherein the game instructions include different sets of instructions each corresponding to a respective skill level.

9. Apparatus as claimed in any one of claims 1 to 3 wherein the game elements comprise first and second support elements for supporting a beam, the support elements being engageable with the container; and a plurality of elements adapted to be stacked on the beam.

10. Apparatus as claimed in any one of claims 1 to 3, wherein the game elements comprise, a plurality of items disposable in a container, magnetic crane means for retrieving one of said items from a container and a timer for timing the duration of a player's turn.

11. Apparatus as claimed in any one of claims 1 to 3 wherein the elements comprise a bridge element connectable to the container and a platform balanced on the bridge element and a plurality of weights for placement on the platform.

12. Apparatus as claimed in claim 11 wherein the weights are of different mass.

* * * * *